US011306523B2

(12) United States Patent
Shin et al.

(10) Patent No.: US 11,306,523 B2
(45) Date of Patent: Apr. 19, 2022

(54) PINCH-PREVENTING SAFETY HINGE FOR HINGED DOOR

(71) Applicant: ZEOMADE CO., LTD., Incheon (KR)

(72) Inventors: Seung Min Shin, Ansan-si (KR); Tae Young Jeong, Guri-si (KR); Hyun Soo Kim, Suwon-si (KR); Young Kwang Kim, Namyangju-si (KR)

(73) Assignee: ZEOMADE CO., LTD., Incheon (KR)

( * ) Notice: Subject to any disclaimer, the term of this patent is extended or adjusted under 35 U.S.C. 154(b) by 0 days.

(21) Appl. No.: 16/489,994

(22) PCT Filed: Sep. 28, 2017

(86) PCT No.: PCT/KR2017/010803
§ 371 (c)(1),
(2) Date: Aug. 29, 2019

(87) PCT Pub. No.: WO2018/164338
PCT Pub. Date: Sep. 13, 2018

(65) Prior Publication Data

US 2019/0383075 A1 Dec. 19, 2019

(30) Foreign Application Priority Data

Mar. 10, 2017 (KR) ..... 10-2017-0030340

(51) Int. Cl.
*E05D 11/00* (2006.01)
*E05D 3/02* (2006.01)
(Continued)

(52) U.S. Cl.
CPC ..... *E05D 11/0054* (2013.01); *E05D 3/02* (2013.01); *E05D 5/02* (2013.01);
(Continued)

(58) Field of Classification Search
CPC ..... E05D 11/0054; E06B 7/367; E06B 2007/365; Y10T 16/533; E05Y 2800/41
See application file for complete search history.

(56) References Cited

U.S. PATENT DOCUMENTS 2,557,716 A * 6/1951 Allee ..... E05D 5/06 16/250
2,952,313 A * 9/1960 Stroup ..... E05D 15/242 160/209
(Continued)

FOREIGN PATENT DOCUMENTS

GB 2456144 A 7/2009
KR 10-1244792 B1 3/2013
(Continued)

*Primary Examiner* — Victor D Batson
*Assistant Examiner* — Matthew J Sullivan
(74) *Attorney, Agent, or Firm* — Park, Kim & Suh, LLC

(57) ABSTRACT

The present invention provides a pinch-preventing safety hinge for a hinged door, which connects a door to a doorjamb mounted in a wall so that the door is opened or closed while rotating about the doorjamb and which includes a hinge unit including a fixing member secured to the doorjamb and a rotary member secured to one side end of the door and hingedly coupled to the fixing member so as to rotate, and a shielding unit rotatably coupled to a rotary shaft of the fixing member or the rotary member, the shielding unit being fixed to the fixing member by hinge motion of the hinge unit.

7 Claims, 13 Drawing Sheets

(51) Int. Cl.
*E05D 5/02* (2006.01)
*E05D 5/12* (2006.01)
*E06B 7/36* (2006.01)

(52) U.S. Cl.
CPC ..... *E05D 2005/122* (2013.01); *E05Y 2800/41* (2013.01); *E05Y 2900/132* (2013.01); *E06B 7/367* (2013.01)

(56) References Cited

U.S. PATENT DOCUMENTS

| | | | | | |
|---|---|---|---|---|---|
| 2,960,733 | A * | 11/1960 | Nida | E06B 7/24 | 49/401 |
| 4,290,233 | A * | 9/1981 | Hubbard | E06B 7/362 | 49/383 |
| 2020/0002989 | A1* | 1/2020 | Bescherer-Nachtmann | E05D 3/02 | |
| 2021/0115715 | A1* | 4/2021 | Kaspersen | E06B 7/362 | |

FOREIGN PATENT DOCUMENTS

| | | | |
|---|---|---|---|
| KR | 10-2014-0105685 | A | 9/2014 |
| KR | 10-1499098 | B1 | 3/2015 |
| KR | 10-1630135 | B1 | 6/2016 |
| KR | 10-1689191 | B1 | 12/2016 |
| WO | WO-2013015542 | A1 * | 1/2013 |
| WO | WO-2018034572 | A1 * | 2/2018 |

* cited by examiner

PINCH-PREVENTING SAFETY HINGE FOR HINGED DOOR

TECHNICAL FIELD

The present invention relates to a pinch-preventing safety hinge for a hinged door, and more particularly, to a pinch-preventing safety hinge for a hinged door, which is capable of preventing an accident from occurring, for example, preventing a part of a user's body from being pinched, when a hinged door is opened or closed about a doorjamb.

BACKGROUND ART

In general, a door provides a function of forming an independent space by dividing one space from another space, and has a structure made of, for example, steel or wood.

A steel door is typically disposed at a boundary of an exterior space to serve as an entrance door, such as a front door and for the purpose of crime prevention, and a wooden door is typically disposed between a space and another space in order to partition an indoor space.

The wooden door has a function of selectively shielding a space defined by a doorframe, including a doorjamb and a door threshold coupled to each other and mounted in a wall of an indoor space, and a sliding door, a hinged door, etc. are representative examples of such wooden doors.

However, since such a conventional interior hinged door has an opening/closing structure in which the door is coupled to the doorjamb by a hinge, a gap is created between the doorjamb and the door when the door is opened, and the gap is eliminated when the door is closed again, which poses a problem in that an accident may occur, for example, a part of a user's body may be pinched in the gap.

DISCLOSURE

Technical Problem

The present invention has been made in view of the above problem, and it is an object of the present invention to provide a pinch-preventing safety hinge for a hinged door, which includes a shielding unit for preventing a gap from being created between a doorjamb and one side end of a door, thereby preventing an accident from occurring, for example, preventing a part of a user's body from being pinched.

Technical Solution

The object of the present invention can be achieved by providing a pinch-preventing safety hinge for a hinged door, configured to connect a door to a doorjamb mounted in a wall so that the door is opened or closed while rotating about the doorjamb, the pinch-preventing safety hinge including a hinge unit including a fixing member secured to the doorjamb and a rotary member secured to one side end of the door and hingedly coupled to the fixing member so as to rotate, and a shielding unit rotatably coupled to a rotary shaft of any one of the fixing member and the rotary member, the shielding unit being fixed to the fixing member by hinge motion of the hinge unit.

In a further aspect of the present invention, provided herein is a pinch-preventing safety hinge for a hinged door, configured to connect a door to a doorjamb mounted in a wall so that the door is opened or closed while rotating about the doorjamb, the pinch-preventing safety hinge including a hinge unit including a fixing member secured to the doorjamb and a rotary member secured to one side end of the door and hingedly coupled to the fixing member so as to rotate, and a shielding unit coupled to an interior of the hinge unit in order to shield an empty interior space in the hinge unit, wherein the fixing member includes a fixing panel extending about a rotary shaft of the hinge unit in a direction perpendicular to the fixing member in the empty interior space in the hinge unit.

Advantageous Effects

A pinch-preventing safety hinge for a hinged door according to the present invention has the following effects.

Firstly, an empty interior space in a shielding unit is not exposed outside during an opening/closing operation of the door, thereby preventing an accident from occurring.

Secondly, the door is guided to a position at which the door is coupled to a rotary member by a cover member, thereby facilitating the installation of the door, and the cover member also covers a gap between the rotary member and the door, thereby ensuring privacy.

Thirdly, since the shielding unit has a rotatable structure, coupling or removal of the shielding unit and the hinge unit is facilitated.

Fourthly, the safety hinge can be easily assembled, and has excellent adaptability and compatibility with general doors.

BEST MODE

Figure 1:
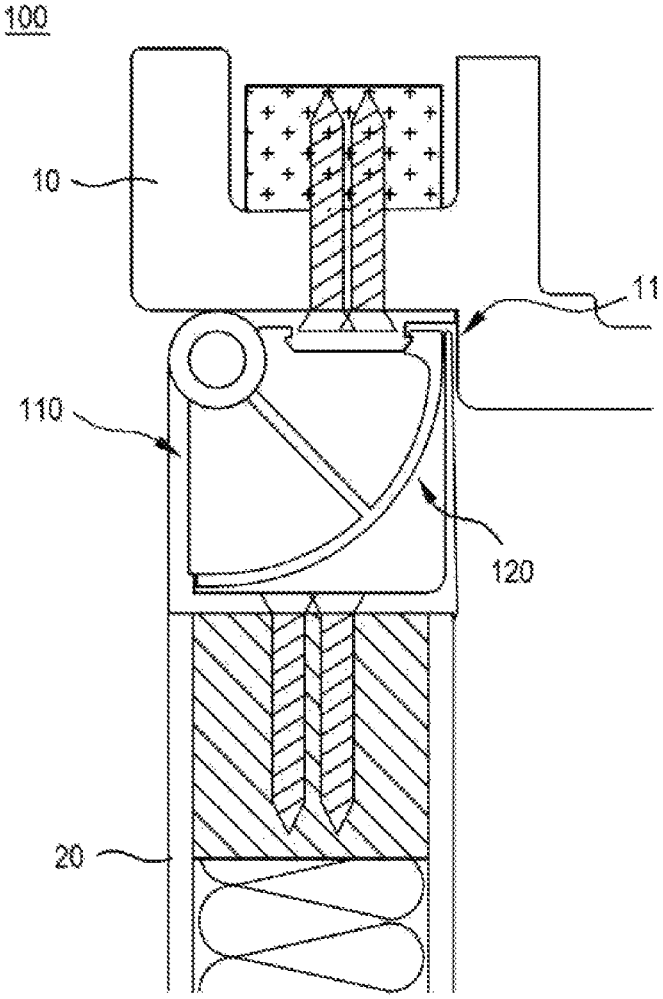
FIG. 1 is a sectional view illustrating the state in which a door equipped with a pinch-preventing safety hinge for a hinged door according to a first embodiment of the present invention is closed.

Reference will now be made in detail to the preferred embodiments of the present invention, examples of which are illustrated in the accompanying drawings. In the drawings, the same or similar elements are denoted by the same reference numerals even though they are depicted in different drawings. In the following description of the present invention, a detailed description of known functions or known configurations incorporated herein will be omitted when it may make the subject matter of the present invention rather unclear. Some features illustrated in the drawings are exaggerated, reduced or simplified for convenience in description and clarity, and the drawings and elements in the drawings are not always illustrated at the actual scale. However, these details will be easily understood by those skilled in the art.

Figure 2:
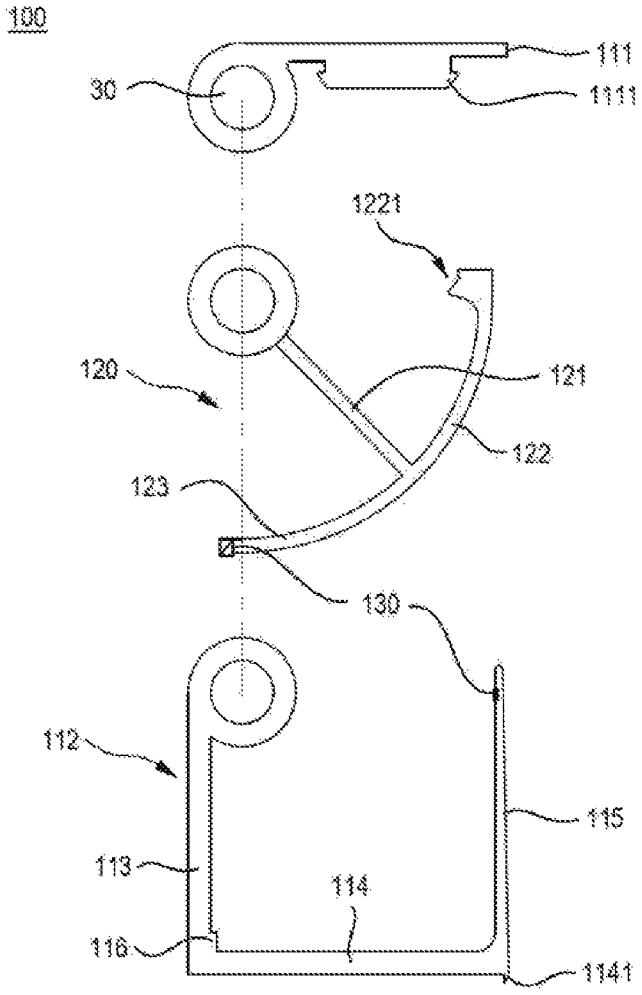
FIG. 2 is an exploded view illustrating a hinge unit and a shielding unit of the pinch-preventing safety hinge for a hinged door shown in FIG. 1 in a separated state.

FIG. 1 is a sectional view illustrating the state in which a door equipped with a pinch-preventing safety hinge for a hinged door according to a first embodiment of the present invention is closed, and FIG. 2 is an exploded view illustrating a hinge unit and a shielding unit of the pinch-preventing safety hinge for a hinged door shown in FIG. 1 in a separated state.

Referring to FIGS. 1 and 2, according to the first embodiment of the present invention, a pinch-preventing safety hinge 100 for a hinged door, which connects a door 20 to a doorjamb 10 mounted in a wall so that the door 20 is opened or closed while rotating about the doorjamb, includes a hinge unit 110 for rotatably connecting the door 20 to the doorjamb 10 and a shielding unit 120 for shielding an empty interior space in the hinge unit 110.

The doorjamb 10 is a kind of pillar that is vertically constructed in a wall such that one side end of the door 20 faces the doorjamb 10 when the door 20 is in a closed state.

The doorjamb 10 has a surface that faces the one side end of the door 20 and that is formed to be flat or to have a step 11, which extends in the longitudinal direction. For example, in the case in which the step 11 is formed, the hinge unit 110 is coupled to a depressed portion of the step 11 such that a portion of the hinge unit 110 is concealed by the step 11, and the opposite side end of the door 20, to which the hinge unit 110 is not coupled, is brought into contact with a step 11 of an opposite doorjamb 10 when the door 20 is closed, whereby the closing angle of the door 20 is restricted. The following description of the embodiment of the present invention is given with the appreciation that the step 11 is formed at the doorjamb 10, by way of example. However, the pinch-preventing safety hinge 100 for a hinged door may also be applicable to a doorjamb 10 having no step.

In addition, the hinge unit 110 includes a fixing member 111, which is secured to the doorjamb 10, and a rotary member 112, which is secured to the one side end of the door and is hingedly coupled to the fixing member 111 so as to rotate relative to the fixing member 111.

The fixing member 111 is secured to a portion of the doorjamb 10, which corresponds to the opening/closing position of the door 20, in the longitudinal direction of the doorjamb 10. If the fixing member 111 is coupled to the step 11, the fixing member 111 is invisibly concealed when the door 20 is in a closed position.

The rotary member 112 includes an extension panel 113, which is hingedly coupled to the fixing member 111, a coupling panel 114, which is bent and extends from the extension panel 113 and is coupled to the one side end of the door 20, and a sliding panel 115, which is bent and extends from the coupling panel 114 so as to be opposite the extension panel 113.

Therefore, the extension panel 113, the coupling panel 114 and the sliding panel 115 are formed in an integral structure so as to have a substantially U-shaped cross-section.

The extension panel 113 is hingedly coupled to the fixing member 111 so as to rotate relative to the fixing member 111. The extension panel 113 and the fixing member 111 may be coupled so as to rotate about the same rotary shaft 30, or may be coupled so as to rotate about mutually different rotary shafts, which have the same center of rotation.

The coupling panel 114 is integrally formed with the extension panel 113 and is bent perpendicular to the extension panel 113, and the door 20 is coupled to the outer surface of the coupling panel 114.

The coupling panel 114 includes a cover member 1141, which protrudes toward the door 20. The cover member 1141 serves to guide the door 20 to the coupling position on the coupling panel 114 or to cover a gap created between the door 20 and the coupling panel 114. The cover member 1141 may protrude toward the door 20 from the outer surface of a portion of the coupling panel 114 that adjoins the sliding panel 115 or the outer surface of a portion of the coupling panel 114 that adjoins the extension panel 113. However, the cover member 1141 may be formed at any position on the coupling panel 114, as long as the cover member 1141 protrudes toward the door. The cover member 1141 exhibits effects of improving soundproofing between the interior space and the exterior space, which are partitioned by the door 20, preventing light leakage to the opposite space, and preventing privacy invasion.

The sliding panel 115 covers the outer surface of the shielding unit 120 when the door 20 is in a closed state, and exposes the shielding unit 120 to the outside when the door 20 is in an opened state. Therefore, when the door 20 is opened or closed, the sliding panel 115 performs sliding motion along the outer surface of the shielding unit 120. Further, when the door 20 is in a closed state, one end of the sliding panel 115 is inserted into the depressed portion of the step 11 formed at the doorjamb 10, thereby covering the entire area of the shielding unit 120. However, the sliding panel 115 may be formed so as to have a length capable of preventing exposure of the shielding unit 120 without being inserted into the depressed portion of the step 11.

A stopper 130 is provided at a position at which the sliding panel 115 and the shielding unit 120 are located close to each other when the door 20 is fully opened, so that the sliding panel 115 and the shielding unit 120 interfere with each other by external force. For example, the stopper 130 may be embodied as one selected from among a bearing and a projection for providing physical interference and a magnetic element for providing interference using magnetic force, and when the door 20 is in a fully opened position, the door 20 may be maintained in an opened state by the interference. However, the function of the stopper 130 may be variously determined as needed.

The shielding unit 120 is coupled to the rotary shaft 30, to which the fixing member 111 and the extension panel 113 are hingedly coupled, so as to rotate about the rotary shaft.

The shielding unit 120 includes a link member 121, which is coupled to the rotary shaft 30, a first shielding plate 122, which is bent and extends from the link member 121, and a second shielding plate 123, which is formed opposite the first shielding plate 122.

The link member 121 is hingedly coupled at one end thereof to the rotary shaft 30, so that the first shielding plate 122 and the second shielding plate 123 rotate about the rotary shaft 30, and accordingly, the shielding unit 120 is coupled to or removed from the fixing member through rotational movement.

The first shielding plate 122 and the second shielding plate 123 are integrally bent from the opposite end of the link member 121 and extend in opposite directions to each other in the shape of a curve that has a radius corresponding to the width of the link member 121. For example, the first shielding plate 122 and the second shielding plate 123 are formed in the shape of an arc that connects the fixing member 111 and the extension panel 113 to each other so as to shield the empty interior space in the hinge unit 110.

Therefore, when the rotary member 112 rotates together with the door 20, the shielding unit 120, which is disposed inside the rotary member 112, interferes with the rotary member 112 and thus rotates in cooperation therewith.

Since the empty interior space in the hinge unit 110 is shielded by the first shielding plate 122 and the second shielding plate 123 of the shielding unit 120, the empty interior space in the hinge unit 110 is not exposed outside even when the door 20 is opened. Therefore, it is possible to prevent an accident from occurring, for example, to prevent a part of a user's body from being pinched.

The fixing member 111 has a first coupling protrusion 1111 protruding therefrom, and the first shielding plate 122 has a first coupling recess 1221 formed at an end thereof that is brought into contact with the fixing member 111, whereby the fixing member 111 and the first shielding plate 122 are coupled to each other through insertion of the first coupling protrusion 1111 into the first coupling recess 1221. When the first shielding plate 122 is coupled to the fixing member 111, the shielding unit 120 is completely fixed. If the shielding unit 120 is completely fixed, when the rotary member 112 rotates, interference between the rotary member 112 and the shielding unit 120 does not occur, and therefore only the rotary member 112 rotates without interference.

In order to couple the shielding unit 120 to the fixing member 111, the shielding unit 120 is pressed by the rotational force of the rotary member 112 before being coupled to the fixing member 111, and is brought into close contact with the fixing member 111. The rotary member 112 has a pressing member 116 formed at the inner surface of the connection portion between the extension panel 113 and the coupling panel 114, and the pressing member 116 serves to contact an end of the second shielding plate 123 so as to press and rotate the shielding unit 120 toward the fixing member 111.

As the pressing member 116 comes into contact with the end of the second shielding plate 123, the second shielding plate 123 is pressed in the tangential direction, and consequently the first coupling protrusion 1111 and the first coupling recess 1221 are coupled to each other. As such, if the shielding unit 120 is completely coupled to the fixing member 111, the pressing member 116 is in simple contact with or is separated from the end of the second shielding plate 123, whereby interference with the shielding unit 120 is eliminated through the rotation of the rotary member 112.

The shielding unit 120 may be removed from the fixing member 111 by pressing the first shielding plate 122 or the second shielding plate 123 so that the second shielding plate 123 rotates toward the pressing member 116 or the extension panel 113. Although not illustrated in the drawings, the rotary member 112 may be provided at the upper portion or the lower portion thereof with a button (not shown), which is selectively inserted or rotated in the rotating direction of the shielding unit 120 so as to interfere with the second shielding plate 123, and this button may be utilized when the shielding unit 120 is intended to be removed from the fixing member 111. Alternatively, the first shielding plate 122 may have a removal recess (not shown) formed in the edge portion thereof such that the removal recess is spaced apart from the fixing member 111 even when the first shielding plate 122 is coupled to the fixing member 111, thereby making it easy to rotate the shielding unit 120 in the direction in which the shielding unit 120 is removed from the fixing member 111.

FIGS. 3 to 6 are reference views sequentially illustrating the processes of assembling the pinch-preventing safety hinge for a hinged door shown in FIG. 1. Hereinafter, the method of assembling the pinch-preventing safety hinge for a hinged door according to the first embodiment of the present invention will be described with reference to the drawings.

Referring to FIGS. 3 to 6, in the pinch-preventing safety hinge 100 for a hinged door according to the first embodiment of the present invention, the fixing member 111, the rotary member 112 and the shielding unit 120 are coupled so as to have the same center of rotation. The fixing member 111, the rotary member 112 and the shielding unit 120 are coupled to the same rotary shaft 30. However, as described above, the above components may be coupled to mutually different rotary shafts, which have the same center of rotation.

Figure 3:
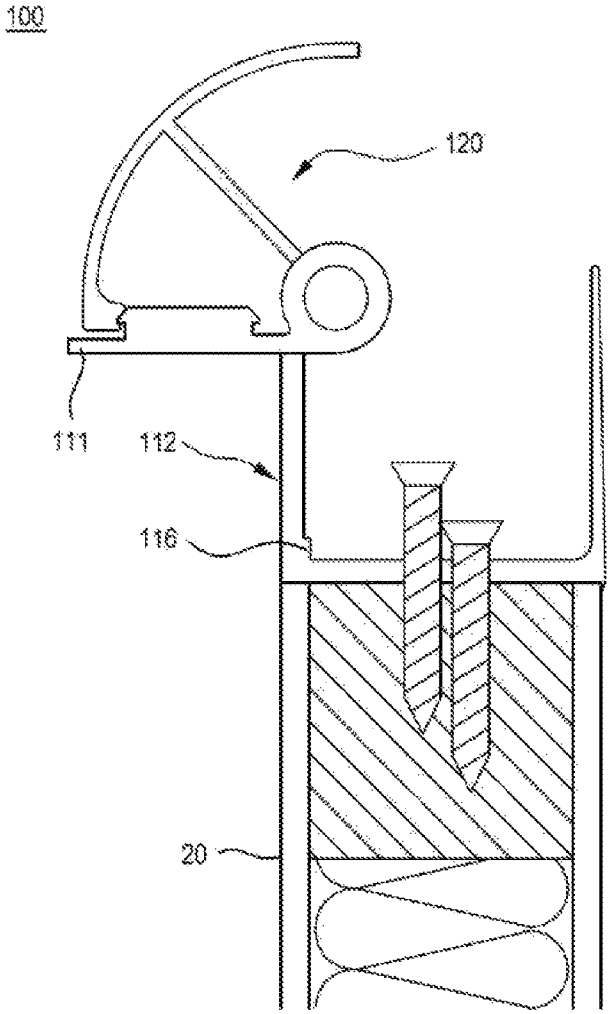
FIGS. 3 to 6 are reference views sequentially illustrating the processes of assembling the pinch-preventing safety hinge for a hinged door shown in FIG. 1.

Subsequently, as shown in FIG. 3, the door 20 and the rotary member 112 are coupled to each other. Although the shielding unit 120 is illustrated as being coupled to the fixing member 111, the shielding unit 120 may not be coupled to fixing member 111. The shielding unit 120 may be located such that the first shielding plate 122 rotates close to the fixing member 111 so that the interior space in the rotary member 112 is exposed.

Figure 4:
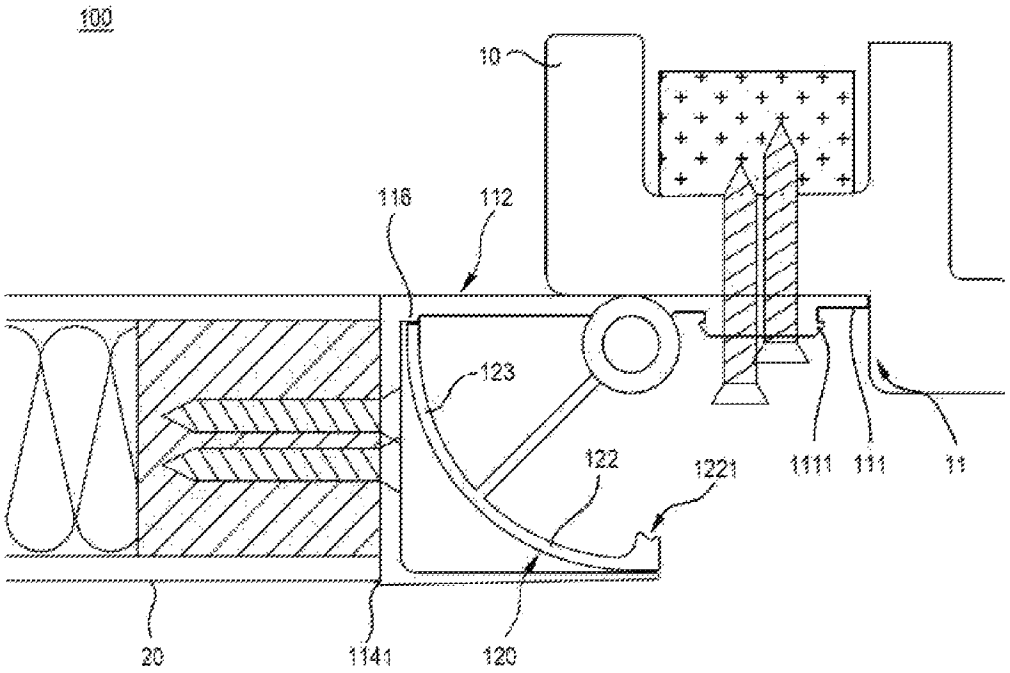

After the door 20 and the rotary member 112 are coupled to each other, as shown in FIG. 4, the fixing member 111 is coupled to the doorjamb 10. At this time, the shielding unit 120 rotates in the reverse direction so that the second shielding plate 123 is located close to the pressing member 116.

Figure 5:
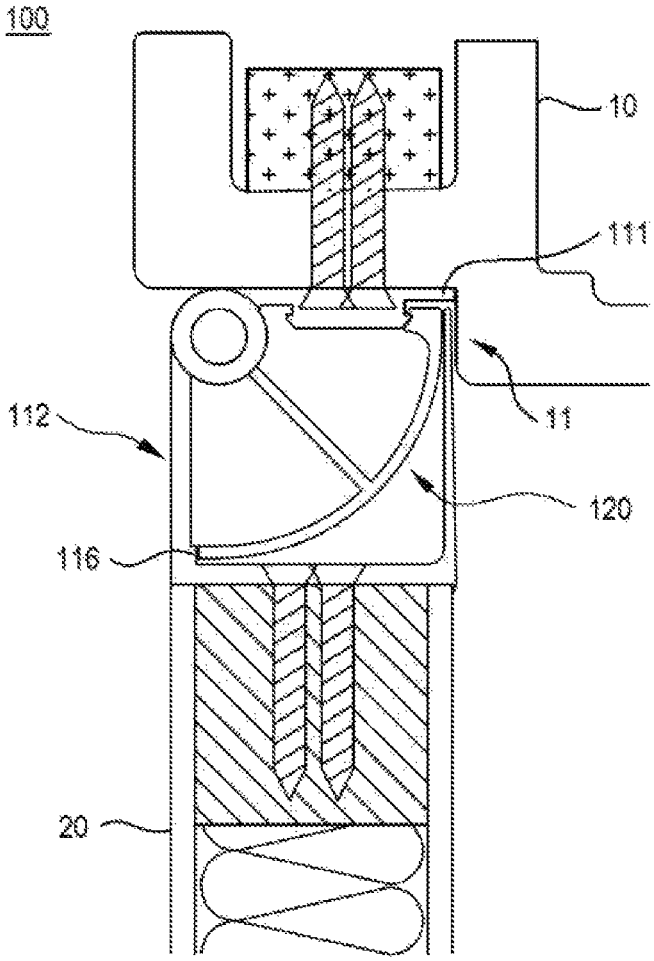

When the fixing member 111 is completely fixed, as shown in FIG. 5, the rotary member 112 rotates together with the door 20, and the shielding unit 120, which is located inside the rotary member 112, also rotates in cooperation with the rotary member 112. At this time, the pressing member 116 presses the second shielding plate 123 so that the first coupling recess 1221 is coupled to the first coupling protrusion 1111. Such coupling between the shielding unit 120 and the fixing member 111 prevents the shielding unit 120 from rotating, and accordingly the empty interior space in the hinge unit 110 is shielded by the shielding unit 120.

Figure 6:
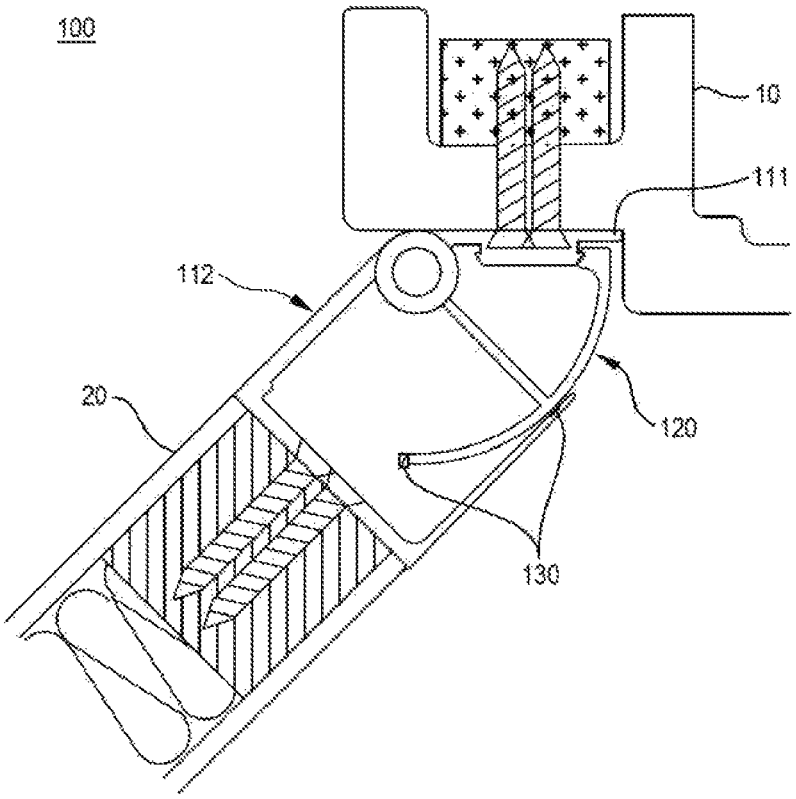

When the shielding unit 120 and the fixing member 111 are completely coupled to each other, as shown in FIG. 6, the empty interior space in the hinge unit 110 is shielded by the shielding unit 120 during the rotation of the rotary member 112 and the door 20, i.e. the opening/closing operation of the door 20, thereby preventing an accident from occurring. In addition, when the door 20 is fully opened and the sliding panel 115 is therefore located near the end of the second shielding plate 123, the stopper 130 disposed therebetween interrupts the closing operation of the door 20, whereby the door 20 may be maintained in an opened state. Therefore, it is possible to prevent the door 20 from being suddenly closed by external force and to prevent an accident attributable to the sudden closing of the door from occurring.

Figure 7:
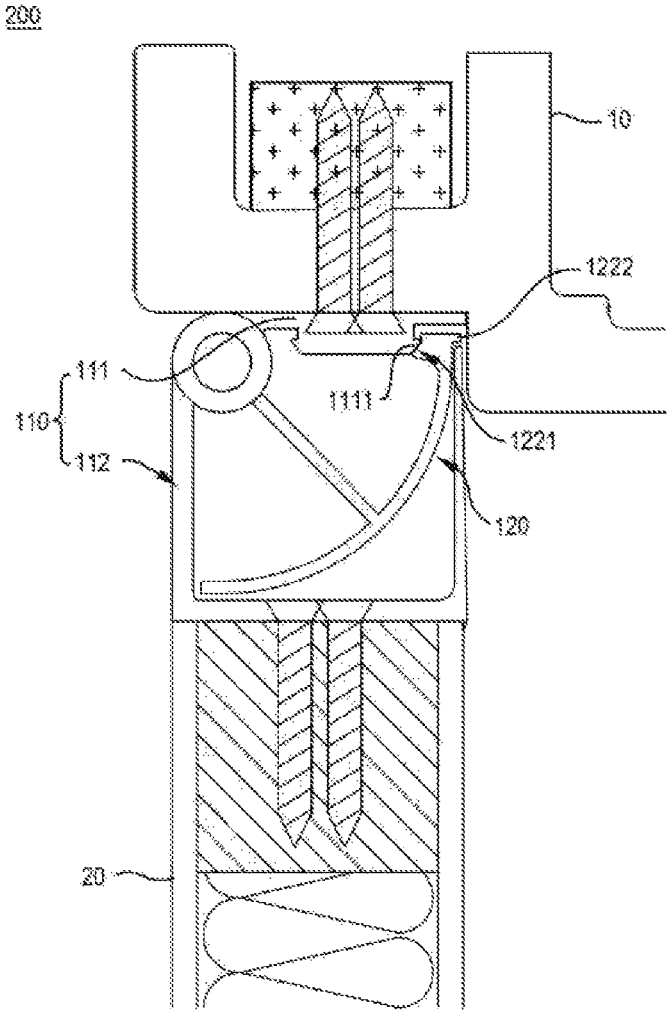
FIG. 7 is a sectional view illustrating the state in which a door equipped with a pinch-preventing safety hinge for a hinged door according to a second embodiment of the present invention is closed.
Figure 8:
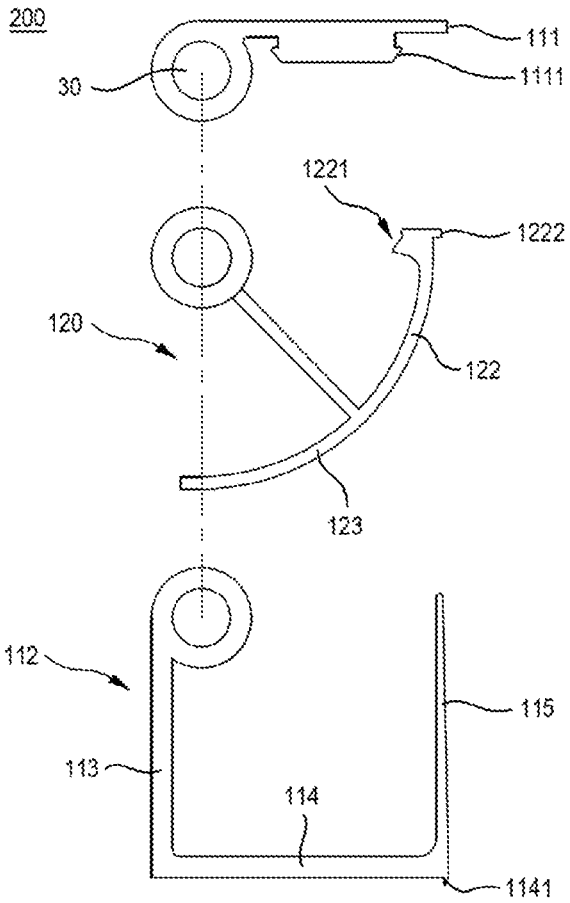
FIG. 8 is an exploded view illustrating a hinge unit and a shielding unit of the pinch-preventing safety hinge for a hinged door shown in FIG. 7 in a separated state.

FIG. 7 is a sectional view illustrating the state in which a door equipped with a pinch-preventing safety hinge for a hinged door according to a second embodiment of the present invention is closed, and FIG. 8 is an exploded view illustrating a hinge unit and a shielding unit of the pinch-preventing safety hinge for a hinged door shown in FIG. 7 in a separated state.

Referring to FIGS. 7 and 8, the pinch-preventing safety hinge 200 for a hinged door according to the second embodiment of the present invention is distinguished from the aspect of the coupling structure between a hinge unit 110 and a shielding unit 120. Hereinafter, differences from the above-described embodiment will be described in detail, and the same reference numerals as those of the above-described embodiment denote the same components.

The pinch-preventing safety hinge 200 for a hinged door according to the second embodiment of the present invention includes a hinge unit 110 and a shielding unit 120. The basic configurations of the hinge unit 110 and the shielding unit 120 are the same as those of the above-described embodiment, but the structure whereby the shielding unit 120 is coupled to a fixing member 111 has distinguishing characteristics.

The shielding unit 120 includes a protruding member 1222, which protrudes from the outer surface of an end of a first shielding plate 122. The protruding member 1222 interferes with the rotary member 112, which rotates at the exterior of the shielding unit 120, so that the shielding unit 120 is coupled to the fixing member 111.

The fixing member 111 is provided with a first coupling protrusion 1111, and the first shielding plate 122 has therein a first coupling recess 1221. Therefore, when the rotary member 112 rotates in the direction in which the door is closed, the protruding member 1222 and the end of a sliding panel 115 interfere with each other, and accordingly the first coupling protrusion 1111 and the first coupling recess 1221 are coupled to each other. As a result, the coupling between the fixing member 111 and the shielding unit 120 is completed.

Although not illustrated in the drawings, the sliding panel 115 may be formed so as to have a length such that insertion thereof into the depressed portion of the step 11 is not possible. In addition, the above-described stopper (not shown) may be provided between a second shielding plate 123 and the sliding panel 115.

In addition, a coupling panel 114 includes a cover member 1141, which protrudes toward the door.

Figure 9:
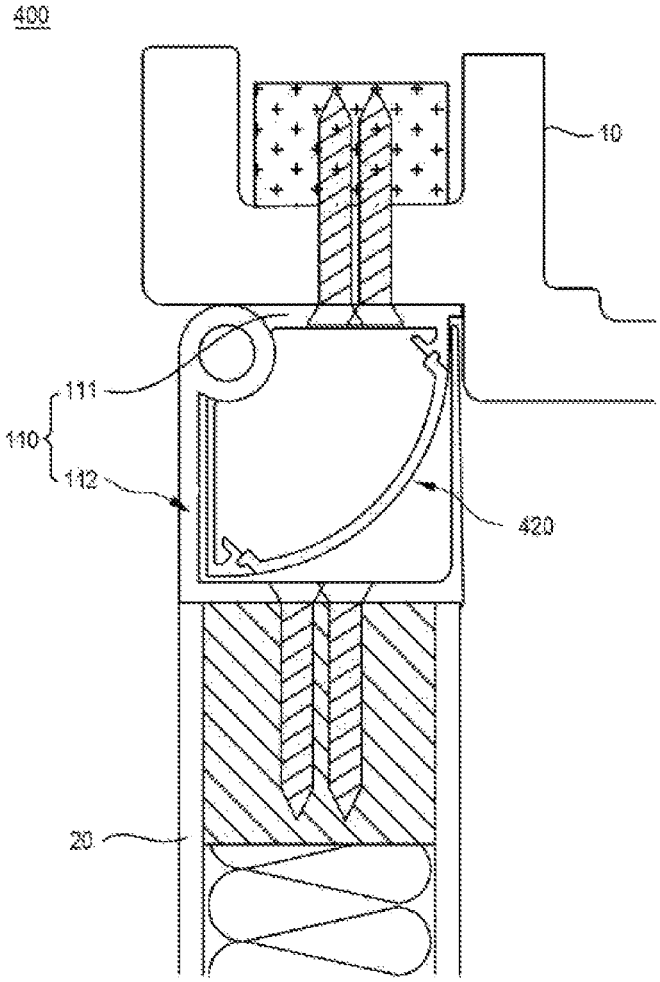
FIG. 9 is a sectional view illustrating the state in which a door equipped with a pinch-preventing safety hinge for a hinged door according to a third embodiment of the present invention is closed.
Figure 10:
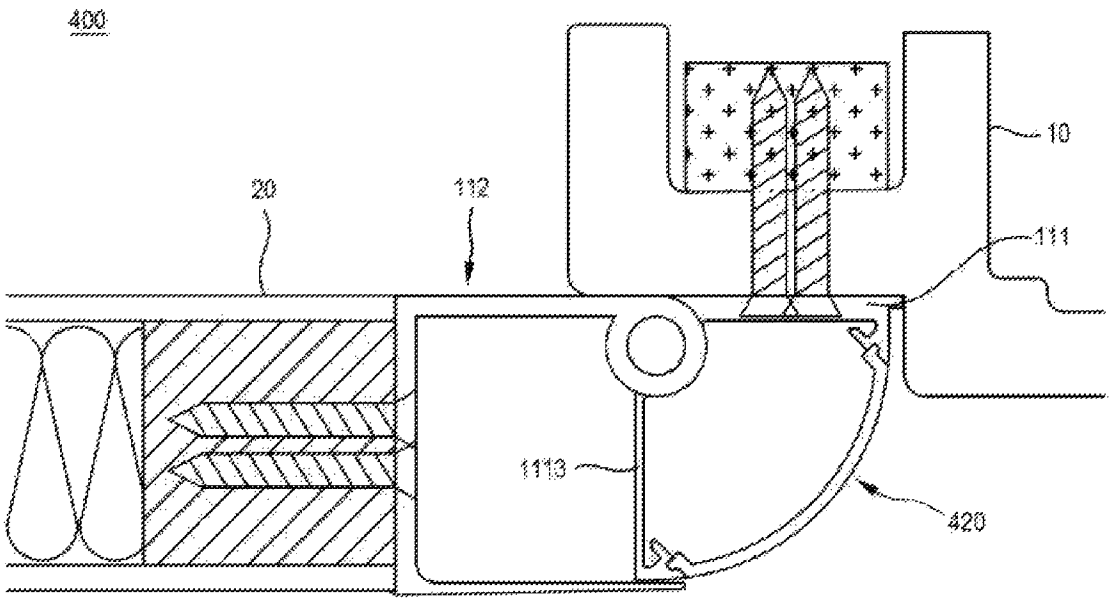
FIG. 10 is a sectional view illustrating the state in which the door equipped with the pinch-preventing safety hinge for a hinged door shown in FIG. 9 is opened.
Figure 11:
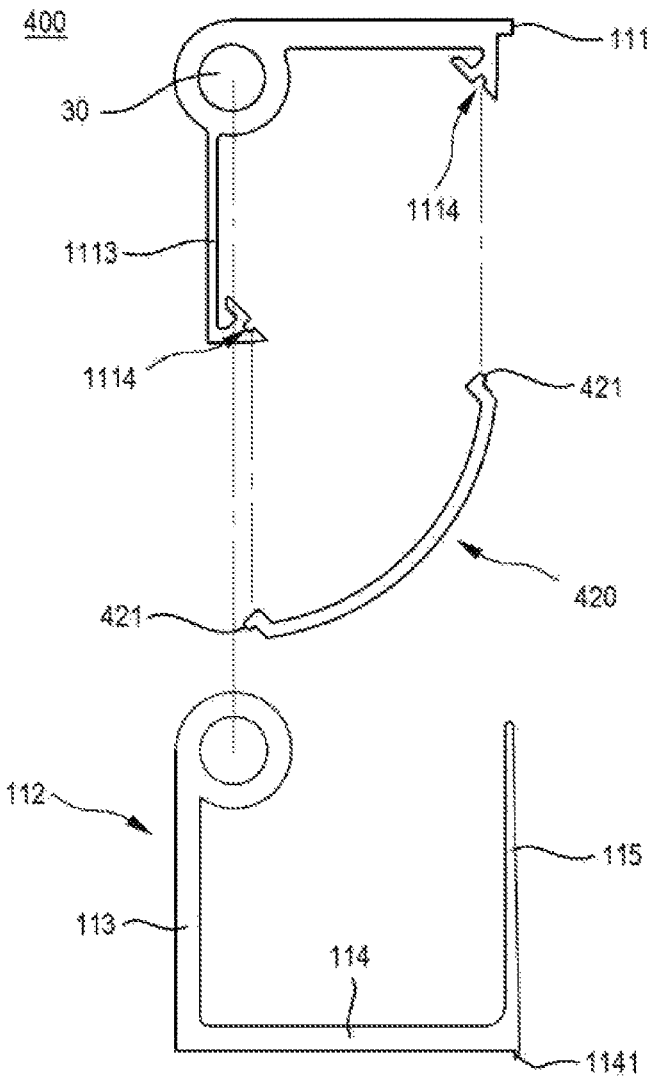
FIG. 11 is an exploded view illustrating a hinge unit and a shielding unit of the pinch-preventing safety hinge for a hinged door shown in FIG. 9 in a separated state.

FIG. 9 is a sectional view illustrating the state in which a door equipped with a pinch-preventing safety hinge for a hinged door according to a third embodiment of the present invention is closed, FIG. 10 is a sectional view illustrating the state in which the door equipped with the pinch-preventing safety hinge for a hinged door shown in FIG. 9 is opened, and FIG. 11 is an exploded view illustrating a hinge unit and a shielding unit of the pinch-preventing safety hinge for a hinged door shown in FIG. 9 in a separated state.

Referring to FIGS. 9 to 11, the pinch-preventing safety hinge 400 for a hinged door according to the third embodiment of the present invention includes a hinge unit 110, which includes a fixing member 111 and a rotary member 112, and a shielding unit 420 for shielding an empty interior space in the hinge unit 110.

The fixing member 111 includes a fixing panel 1113, which is arranged parallel to an extension panel 113 in the empty space when the door is in a closed state. The fixing panel 1113 is formed integrally with the fixing member 111 and extends about the rotary shaft 30 of the fixing member 111 and the rotary member 112 so as to be perpendicular to the fixing member 111.

The shielding unit 420 is formed in a curved shape such that one end thereof is coupled to the fixing member 111 and the opposite end thereof is coupled to the fixing panel 1113. Therefore, the shielding unit 420 shields an empty space that is created in the hinge unit 110 when the hinge unit 110 performs hinge motion.

The fixing member 111 and the fixing panel 1113 have third coupling recesses 1114 formed at portions thereof to which the shielding unit 420 is coupled, and the shielding unit 420 is provided with third coupling protrusions 421 formed so as to be inserted into the third coupling recesses 1114. As such, since the configuration of the shielding unit 420 is simple, it is convenient to manufacture and assemble the shielding unit 420, and it is possible to manufacture the shielding unit 420 using synthetic resin, such as plastic, as well as a steel material, which brings about an advantage in that manufacturing costs are reduced.

Although not illustrated in the drawings, the above-described stopper (not shown) may be provided between the fixing panel 1113 and a sliding panel 115.

In addition, a coupling panel 114 includes a cover member 1141, which protrudes toward the door.

Figure 12:
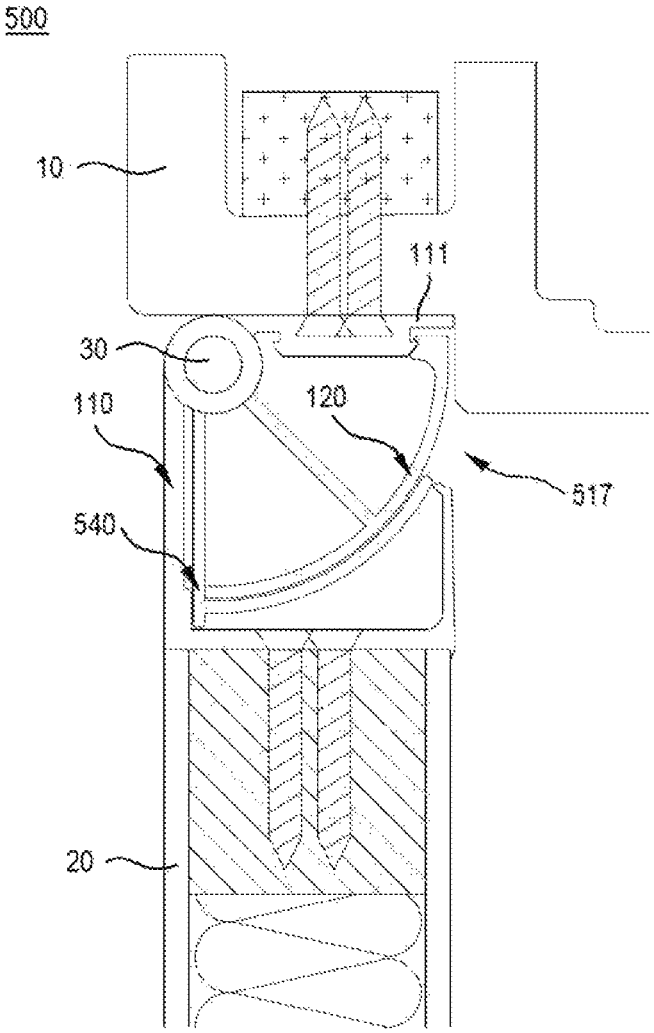
FIG. 12 is a sectional view illustrating the state in which a door equipped with a pinch-preventing safety hinge for a hinged door according to a fourth embodiment of the present invention is closed.
Figure 13:
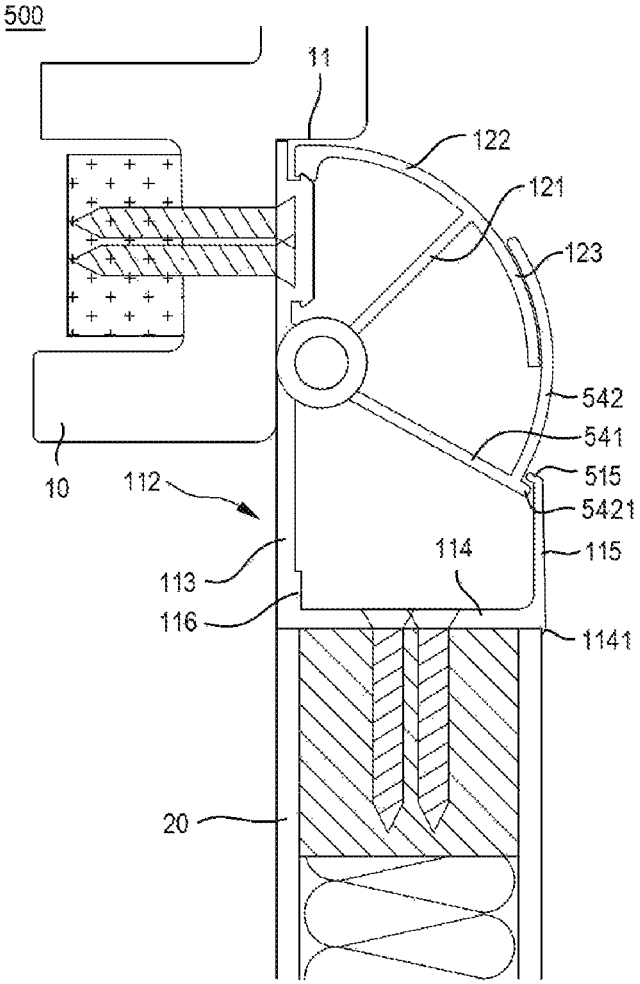
FIG. 13 is a sectional view illustrating the state in which the door equipped with the pinch-preventing safety hinge for a hinged door shown in FIG. 12 is opened.

FIG. 12 is a sectional view illustrating the state in which a door equipped with a pinch-preventing safety hinge for a hinged door according to a fourth embodiment of the present invention is closed, and FIG. 13 is a sectional view illustrating the state in which the door equipped with the pinch-preventing safety hinge for a hinged door shown in FIG. 12 is opened.

Referring to FIGS. 12 and 13, the pinch-preventing safety hinge 500 for a hinged door according to the fourth embodiment of the present invention includes a hinge unit 110, which includes a fixing member 111 and a rotary member 112, which are hingedly coupled to each other, a shielding unit 120, which is coupled to the fixing member 111 by hinge motion of the hinge unit 110, and an extension unit 540 for shielding the external surface of the shielding unit 120. The same reference numerals as those of the above-described embodiments denote the same components.

The configurations of the fixing member 111 and the shielding unit 120 are substantially the same as those of the above-described embodiments, and the extension unit 540 is provided so as to rotate together with the shielding unit 120 between the fixing member 111 and the rotary member 112. The rotary member 112 includes an extension panel 113, a coupling panel 114, and a sliding panel 115. The sliding panel 115 is provided with a latching protrusion 515, which protrudes outwards so as to interfere with a portion of the extension unit 540. The sliding panel 115 is formed to have a length shorter than that of the sliding panel in the above-described embodiments so that the sliding panel 115 is not inserted into the depressed portion of the step 11 of the doorjamb 10 when the door is in a fully closed state. Therefore, as shown in FIG. 12, when the door 20 is in a fully closed state, a protection area 517, through which the portion of the shielding unit 120 that is located near the fixing member 111 is exposed to the outside, is formed.

The extension unit 540 is disposed at the exterior of the shielding unit 120, whereby when the door 20 is opened, the extension unit 540 performs sliding motion along the external surface of the shielding unit 120, and when the door 20 is in a fully opened state, the extension unit 540 covers at least a portion of the external circumferential surface of the shielding unit 120.

The extension unit 540 includes a connection member 541, which is coupled to a rotary shaft 30, a fifth shielding plate 542, which is integrally bent and extends from the connection member 541 and is formed to have a shape corresponding to the shape of a second shielding plate 123 of the shielding unit 120, and a latching member 5421, which protrudes from the connection portion between the connection member 541 and the fifth shielding plate 542 along the extension line of the connection member 541 in the outward direction of the fifth shielding plate 542.

The connection member 541 is formed to be longer than a link member 121 so that the extension unit 540 is disposed at the exterior of the shielding unit 120.

The fifth shielding plate 542 is arranged to cover the first shielding plate 122 and the second shielding plate 123 of the shielding unit 120 such that, when the door 20 is in a closed state, the fifth shielding plate 542 does not cover at least a portion of the first shielding plate 122 so that the protection area 517 is exposed, and when the door 20 is in an opened state, the fifth shielding plate 542 covers at least a portion of the second shielding plate 123 so that the interior space in the shielding unit 120 is prevented from being exposed to the outside.

When the shielding unit 120 is intended to be coupled to the fixing member 111, the connection member 541 of the extension unit 540 is first brought into contact with a pressing member 116, and as the door 20 rotates to a closed position, the second shielding plate 123 is brought into contact with the inner surface of the connection member 541, whereby the rotary member 112, the extension unit 540 and the shielding unit 120 rotate together. When the door 20 reaches a fully closed position, the shielding unit 120 is coupled to the fixing member 111.

After the shielding unit 120 is coupled to the fixing member 111, as the door 20 is opened, the latching protrusion 515 and the latching member 5421 interfere with each other, and accordingly the extension unit 540 is rotated in cooperation with the rotary member 112. The extension unit 540 performs sliding motion along the outer circumferential surface of the shielding unit 120 due to the rotational movement, and even when the door 20 is in a fully opened state, the fifth shielding plate 542 covers a portion of the second shielding plate 123, thereby preventing the interior space in the shielding unit 120 from being exposed to a user.

When the door 20 is in a fully closed state, the latching protrusion 515 protruding from the end of the sliding panel 115 may preferably be located adjacent to the end of the fifth shielding plate 542. Therefore, the protection area 517 is formed between the doorjamb 10 and the sliding panel 115 around a portion of the outer circumferential surface of the first shielding plate 122, and similar to the closing operation of the door 20 described in the above embodiments, when the sliding panel performs sliding motion along the outer circumferential surface of the shielding unit, contact between a part of a user's body and the sliding panel is prevented from occurring, thereby ensuring the safe opening/closing operation of the door.

Although not illustrated in the drawings, the above-described stopper (not shown) may be provided between the second shielding plate 123 and the fifth shielding plate 542.

In addition, the coupling panel 114 includes a cover member 1141, which protrudes toward the door.

Although the present invention has been described with reference to the preferred embodiments, it is to be understood that various modifications or changes can be made without departing from the technical spirit and the scope of the invention as disclosed in the accompanying claims by those skilled in the art. Therefore, the scope of the present invention should be interpreted by the following claims, which have been set forth so as to include such various changes.

SEQUENCE LIST FREE TEXT

100, 200, 400, 500: pinch-preventing safety hinge for hinged door

The invention claimed is:

1. A pinch-preventing safety hinge for a hinged door, configured to connect a door to a doorjamb mounted in a wall so that the door is opened or closed while rotating about the doorjamb, the pinch-preventing safety hinge comprising:

a hinge unit comprising a fixing member secured to the doorjamb and a rotary member secured to one side end of the door and hingedly coupled to the fixing member so as to rotate; and a shielding unit rotatably coupled to a rotary shaft of any one of the fixing member and the rotary member, wherein the rotary member comprises:

an extension panel hingedly coupled to the fixing member;

a coupling panel extending integrally from the extension panel and secured to the one side end of the door; and a sliding panel protruding integrally from the coupling panel, the sliding panel performing sliding motion to cover the shielding unit during an opening/closing operation of the door, wherein the shielding unit comprises:

a link member disposed between the fixing member and the rotary member and coupled at one end thereof to the rotary shaft;

a first shielding plate extending integrally from an opposite end of the link member in a predetermined direction, the first shielding plate being selectively coupled to the fixing member; and a second shielding plate extending integrally from the opposite end of the link member in a direction opposite the first shielding plate, the second shielding plate being selectively brought into contact with the rotary member, wherein any one of the fixing member and the first shielding plate has a first coupling protrusion and a remaining one of the fixing member and the first shielding plate has a first coupling recess formed to allow the shielding unit to be detachably coupled to the fixing member, wherein the rotary member further comprises a pressing member, wherein when the door is closed, the pressing member presses and rotates the second shielding plate toward the fixing member such that the shielding unit is detachably coupled to the fixing member.

2. The pinch-preventing safety hinge according to claim 1, further comprising:

a stopper disposed between the sliding panel and the shielding unit, wherein, when the door is in a fully opened state, the sliding panel and the shielding unit interfere with each other due to the stopper.

3. The pinch-preventing safety hinge according to claim 1, wherein the rotary member comprises a cover member protruding from an outer surface of any one of a portion at which the coupling panel and the sliding panel adjoin each other and a portion at which the coupling panel and the extension panel adjoin each other in a direction in which the coupling panel is coupled to the door in order to cover a gap between the door and the coupling panel.

4. The pinch-preventing safety hinge according to claim 1, further comprising:

an extension unit rotatably coupled to the rotary shaft of any one of the fixing member and the rotary member, wherein, when the hinge unit performs hinge motion, the extension unit interferes with rotation of the rotary member and performs sliding motion to shield an external surface of the shielding unit.

5. The pinch-preventing safety hinge according to claim 4, wherein the extension unit comprises:

a connection member hingedly coupled to the rotary shaft;

a fifth shielding plate extending integrally from the connection member and formed to have a curved shape corresponding to an outer circumferential surface of the shielding unit so as to perform sliding motion along the outer circumferential surface of the shielding unit; and a latching member protruding from an outer circumferential surface of one end of the fifth shielding plate so as to interfere with a latching protrusion formed at an end of the sliding panel.

6. The pinch-preventing safety hinge according to claim 5, wherein, when the door is in a closed state, the latching protrusion is located on a same line as an opposite end of the fifth shielding plate or is located at a position that is short of the opposite end of the fifth shielding plate.

7. The pinch-preventing safety hinge according to claim 5, wherein, when the door is in a closed state, the fifth shielding plate exposes an outer circumferential surface of a portion of the first shielding plate that is near the fixing member.

* * * * *